US005584784A

United States Patent [19]

Wu

[11] Patent Number: 5,584,784

[45] Date of Patent: Dec. 17, 1996

[54] FOLDABLE HORSE RIDING TYPE EXERCISER

[76] Inventor: Tien-Lai Wu, 58, Ma Yuan West St., Taichung, Taiwan

[21] Appl. No.: 443,734

[22] Filed: May 18, 1995

[51] Int. Cl.[6] ..... A63B 69/06

[52] U.S. Cl. ..... 482/95; 482/96; 482/72; 482/57

[58] Field of Search ..... 482/95, 130, 96, 482/137, 57, 71, 72, 51; 472/106, 110

[56] References Cited

U.S. PATENT DOCUMENTS 5,299,997 4/1994 Chen .
5,330,404 7/1994 Lopeteguy ..... 482/142
5,458,553 10/1995 Wu ..... 482/95
5,464,378 11/1995 Yu ..... 482/95

*Primary Examiner*—Jerome Donnelly

[57] ABSTRACT

A horse riding type exerciser includes a base, a pair of seat posts and a foot post pivotally coupled to the base. A column is pivotally coupled to the seat posts and has a pair of rollers rotatably engaging with the base. A handle engaged in the column and has a hand grip secured to the handle for pulling the handle. A link pivotally couples the foot post to the column. The hand grip is pulled in order to simulate horse riding type exercises. The handle is disengaged from the column and the link is disengaged from the foot post so as to fold the exerciser to a compact configuration.

1 Claim, 3 Drawing Sheets

FOLDABLE HORSE RIDING TYPE EXERCISER

BACKGROUND OF THE INVENTION

1. Field of the Invention

The present invention relates to a horse riding type exerciser, and more particularly to a foldable horse riding type exerciser.

2. Description of the Prior Art

Typical horse riding type exercisers comprise a handle means that may be pulled to elevate the seat portion so as to simulate horse riding exercises. However, the typical horse riding type exercisers may not be folded to a compact configuration and include a large volume that is adverse for storing and transportation purposes.

The present invention has arisen to mitigate and/or obviate the afore-described disadvantages of the conventional horse riding type exercisers.

SUMMARY OF THE INVENTION

The primary objective of the present invention is to provide a horse riding type exerciser which may be folded to a rather compact configuration that is excellent for storing and for transportation purposes.

In accordance with one aspect of the invention, there is provided a horse riding type exerciser comprising a base portion including a pair of parallel beams and at least one bar coupled between the beams, the base portion including a front portion, a middle portion and a rear portion, two stop means provided in the middle portion and the rear portion of the base portion respectively, a pair of seat posts including a front and lower portion pivotally coupled to the front portion of the base portion and including a rear and upper portion having a seat cushion provided thereon, the seat posts including a middle portion, a column including a middle portion pivotally coupled to the middle portion of the seat posts and including a rear and lower portion having a shaft secured thereto, the column including a front and upper portion, a pair of rollers secured to the Shaft for engaging with the beams, the rollers being moved between the stop means, a handle engaged in the front and upper portion of the column and including a hand grip means secured thereto for pulling the handle and the column, a foot post including a lower portion pivotally coupled to the front portion of the base portion and including an upper portion having a pair of foot pedals secured thereto, and a link including a first end pivotally coupled to the upper portion of the foot post at a pivot pin and including a second end pivotally coupled to the middle portion of the column. The rollers are caused to move forward along the beams when the hand grip means is pulled, in order to elevate the seat cushion and so as to simulate horse riding type exercises, and the handle is disengaged from the column, and the link is disengaged from the foot post by disengaging the pivot pin from the foot post so as to fold the horse riding type exerciser to a compact configuration.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
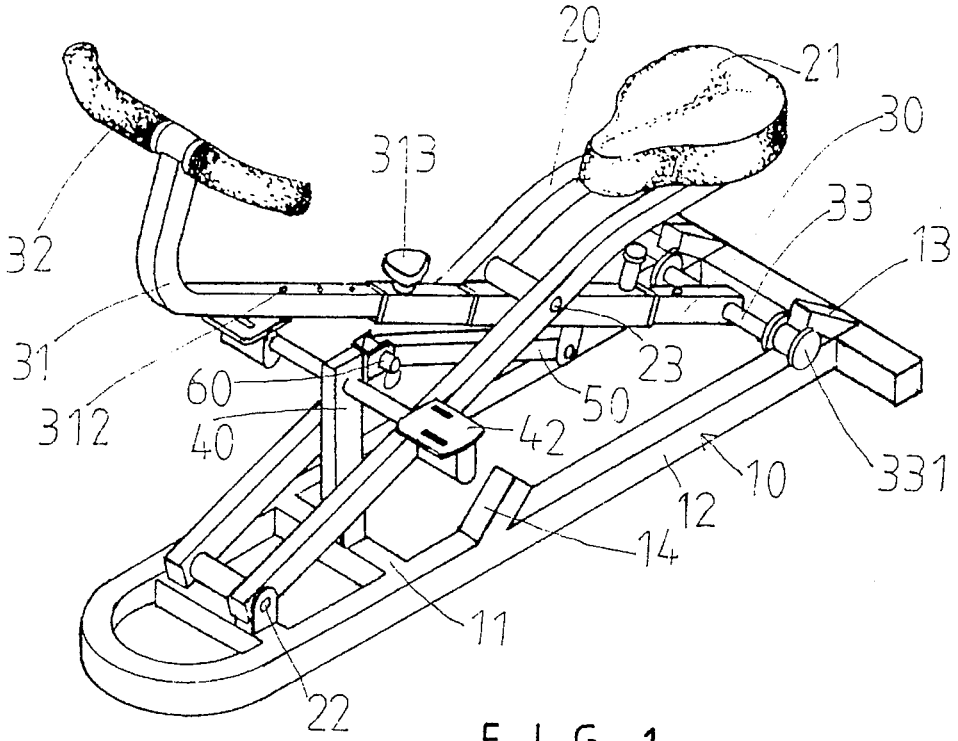
FIGS. 1 and 2 are perspective views illustrating the operation of a horse riding type exerciser in accordance with the present invention.
Figure 2:
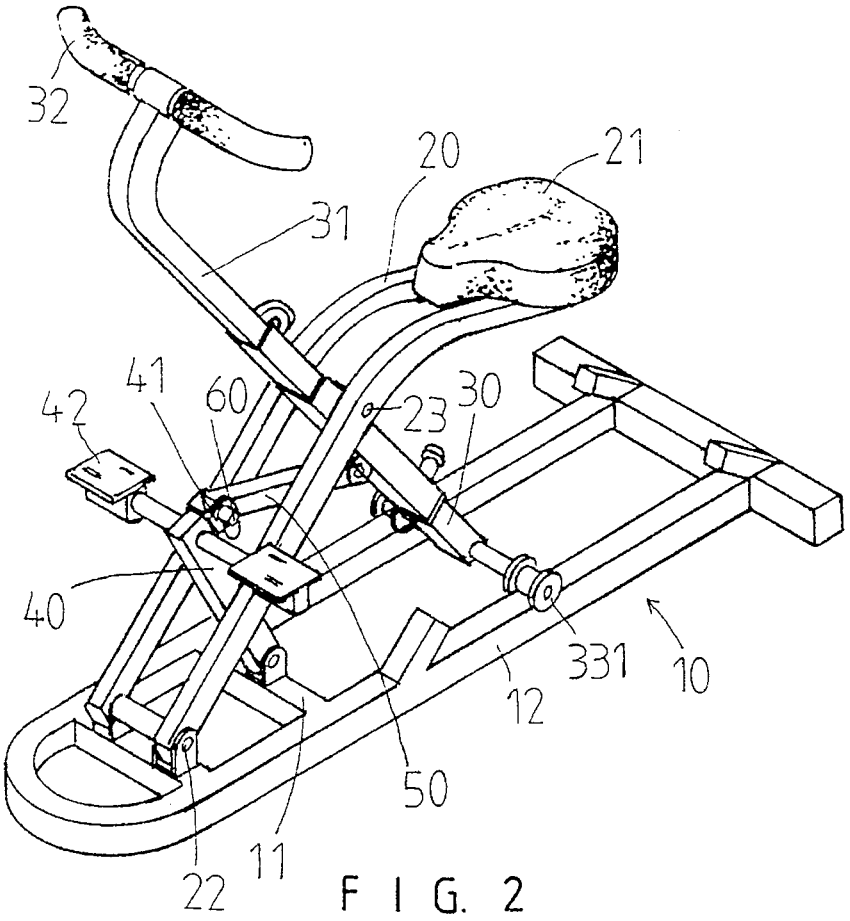

Referring to the drawings, and initially to FIGS. 1 and 2, a horse riding type exerciser in accordance with the present invention comprises a base portion 10 including a pair of parallel and longitudinal beams 12 and one or more bars 11 laterally secured between the beams 12. A pair of stops 13 are provided on the rear portion of the base portion 10 and another pair of stops 14 are provided on the middle portion of the beams 12. The stops 13, 14 are preferably made of rubber materials for absorbing shocks and vibrations. A foot post 40 has a lower end pivotally coupled to the front portion of the base 10 and has a pair of foot pedals 42 provided on top thereof. The foot post 40 further includes a bracket 41 provided on top thereof.

A pair of seat posts 20 include a front and lower portion pivotally coupled to the base portion 10 with a pivot pin 22 and include a seat cushion 21 provided on the rear and upper portion thereof. A column 30 has a middle portion pivotally coupled to the middle portion of the seat posts 20 by a pivot axle 23 and includes a shaft 33 secured to the rear and bottom portion. The shaft 33 includes two pulleys or rollers 331 provided on the end portions for slidably or rotatably engaged on the beams 12 and movable between the stops 13, 14. A handle 31 has one end slidably engaged in the column 30 and has a pair of hand grips 32 provided on the other end thereof. The column 30 includes a fastening member 313 engaged thereon for engaging with either of a number of screw holes 312 provided in the handle 31, such that the handle 31 may be adjusted relative to the column 30. A link 50 has one end pivotally coupled to the bracket 41 by a pin element 60 and has the other end pivotally coupled to the middle portion of the column 30.

In operation, when the hand grips 32 are pulled by the user who is seated on the seat cushion 21, the rollers 331 may be caused to move forward along the beams 12 such that the seat posts 20 may be caused to rotate about the pivot pin 22. The seat cushion 21 may thus be elevated in order to simulate horse riding type exercises.

Figure 3:
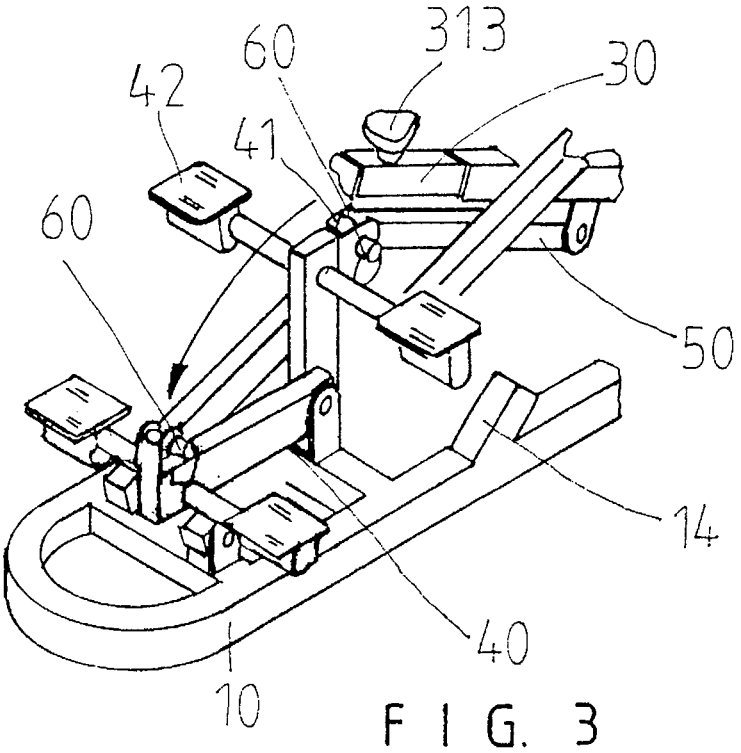
FIGS. 3, 4, 5 are schematic views illustrating the folding processes of the horse riding type exerciser.
Figure 4:
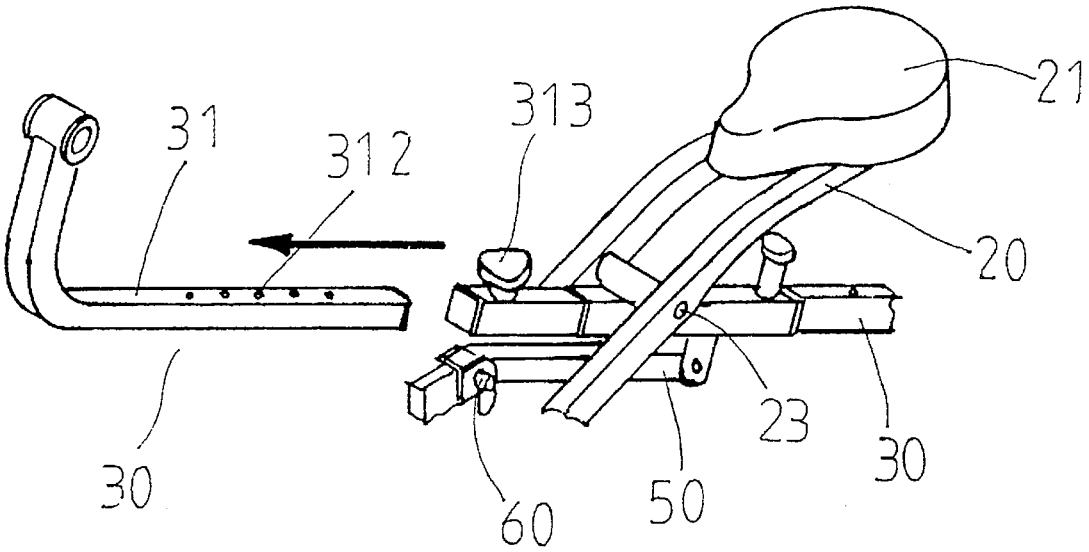
Figure 6:
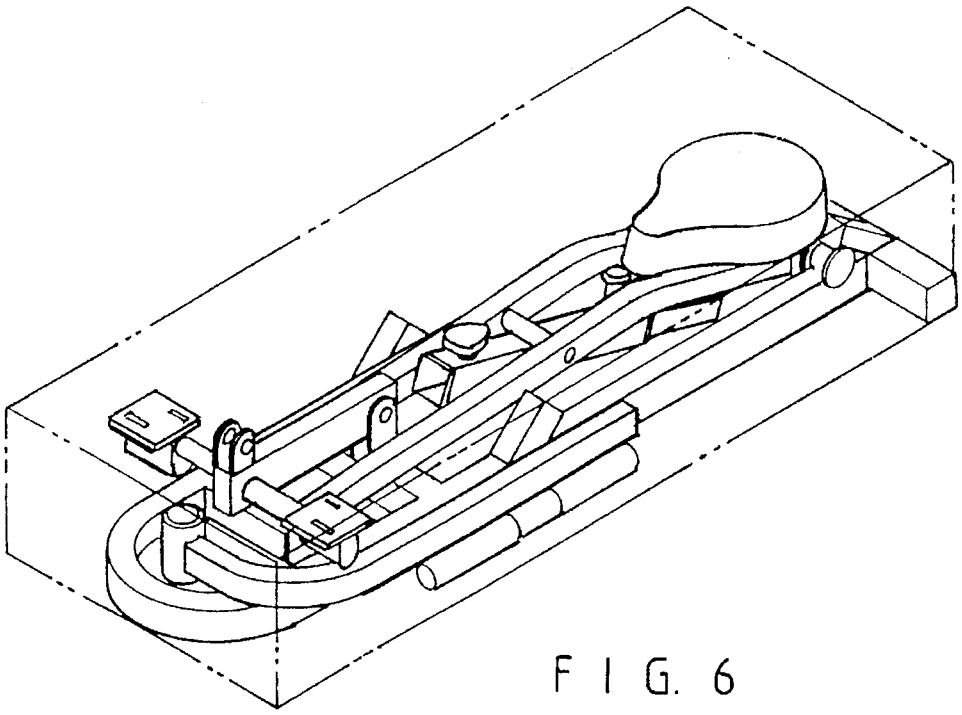
FIG. 6 is a perspective view illustrating the folding configuration of the horse riding type exerciser.
Figure 5:
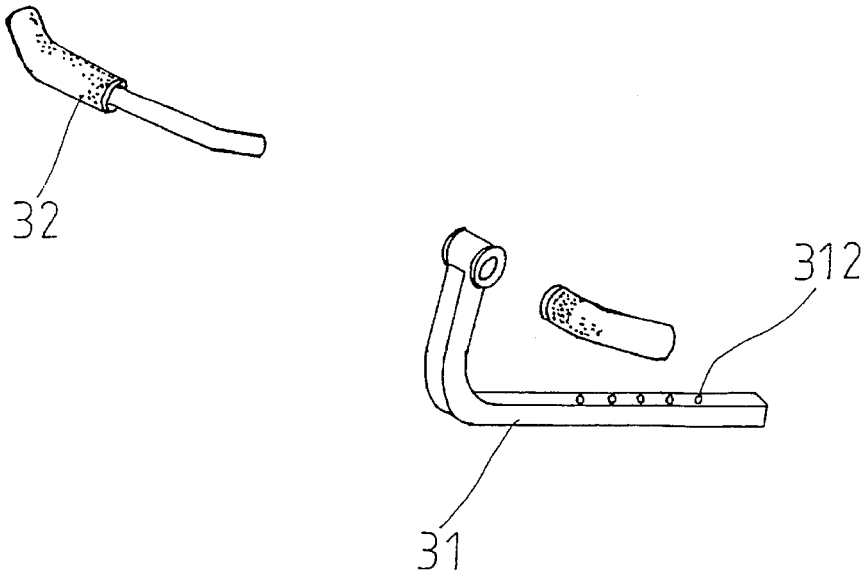

Referring next to FIG. 3, when it is required to fold the horse riding type exerciser, the pin element 60 is first disengaged from the bracket 41 such that the foot post 40 may be folded to engage with the base portion 10. As shown in FIGS. 4 and 5, the handle 31 is then disengaged from the column 30 by unthreading the fastening member 313 and the hand grips 32 are disengaged from the handle 31. The horse riding type exerciser may thus be folded to a rather compact configuration as shown in FIG. 6.

Accordingly, the horse riding type exerciser may be folded to a rather compact configuration that is excellent for storing and for transportation purposes.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A foldable exerciser comprising:

a base portion including a pair of parallel beams and at least one bar coupled between said beams, said base portion including a front portion, a middle portion and a rear portion, two stop means provided in said middle portion and said rear portion of said base portion respectively, a pair of seat posts including a front and lower portion pivotally coupled to said front portion of said base portion and including a rear and upper portion having a seat cushion provided thereon, said seat posts including a middle portion, a column including a middle portion pivotally coupled to said middle portion of said seat posts and including a rear and lower portion having a shaft secured thereto, said column including a front and upper portion, a pair of rollers secured to said shaft for engaging with said beams, said rollers being moved between said stop means, a handle engaged in said front and upper portion of said column and including a hand grip means secured thereto for pulling said handle and said column, a foot post including a lower portion pivotally coupled to said front portion of said base portion and including an upper portion having a pair of foot pedals secured thereto, and a link including a first end pivotally coupled to said upper portion of said foot post with a pivot pin and including a second end pivotally coupled to said middle portion of said column, said rollers being caused to move forward along said beams, when said hand grip means is pulled, in order to elevate said seat cushion and so as to simulate said foldable exerciser, and said handle being disengagable from said column, said link being disengagable from said foot post by disengaging said pivot pin from said foot post to fold said foot post toward said base portion, and said seat posts being folded toward said base portion so as to fold said foldable exerciser to a compact configuration.

* * * * *